US007886901B1

(12) United States Patent
Singh et al.

(10) Patent No.: US 7,886,901 B1
(45) **Date of Patent: *Feb. 15, 2011**

(54) CLAM SHELL PACKAGING DEVICE

(75) Inventors: Amit Singh, Toronto (CA); Jeffery Balaban, Laguna Niguel, CA (US); David Wroniak, Garden Grove, CA (US)

(73) Assignee: Division Six Sports, Inc., Encino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/698,067

(22) Filed: Feb. 1, 2010

Related U.S. Application Data

(63) Continuation-in-part of application No. 12/554,746, filed on Sep. 4, 2009, now Pat. No. 7,819,245.

(51) Int. Cl.
*B65D 85/20* (2006.01)

(52) U.S. Cl. ..... 206/315.1; 206/467; 206/303; 206/335

(58) Field of Classification Search ..... 206/335, 206/303, 304, 304.1, 304.2, 470, 471, 315.1; 220/4.21–4.23, 632, 772; 211/20; 446/75, 446/78

See application file for complete search history.

(56) References Cited

U.S. PATENT DOCUMENTS

| | | | | | |
|---|---|---|---|---|---|
| 4,128,254 | A | * | 12/1978 | Powell | 280/87.042 |
| 4,315,569 | A | * | 2/1982 | Jaeschke | 229/122 |
| D469,348 | S | * | 1/2003 | Demus et al. | D9/415 |
| D469,686 | S | | 2/2003 | Yang | |
| D470,409 | S | * | 2/2003 | Clarke et al. | D9/415 |

OTHER PUBLICATIONS

Office Action issued on Apr. 2, 2010 in U.S. Appl. No. 12/554,746.

* cited by examiner

*Primary Examiner*—Ehud Gartenberg
*Assistant Examiner*—Raven Collins
(74) *Attorney, Agent, or Firm*—Jeffer Mangels Butler & Mitchell LLP

(57) ABSTRACT

A packaging device preferably including a clam shell, wherein the clam shell is adapted to at least partially encase a single wheel of a device with wheels.

16 Claims, 12 Drawing Sheets

CLAM SHELL PACKAGING DEVICE

RELATED APPLICATION

This application is a continuation-in-part of U.S. application Ser. No. 12/554,746, filed Sep. 4, 2009, the content of which is incorporated by reference in its entirety.

FIELD OF INVENTION

This invention is related to packaging for wheeled devices and methods of using the same.

BACKGROUND OF THE INVENTION

Wheeled devices, such as skateboards, are normally packaged in boxes or some other bulky structures, such as cardboard boxes. Because of the protruding wheels on such devices, such boxes tend to be very large and tend to take up a large amount of space from the moment they are packaged and placed in inventory to the moment they are placed in retail stores.

BRIEF DESCRIPTION OF THE DRAWINGS

The invention may be more readily understood by referring to the accompanying drawings in which.

SUMMARY OF THE PREFERRED EMBODIMENTS

Figure 1:
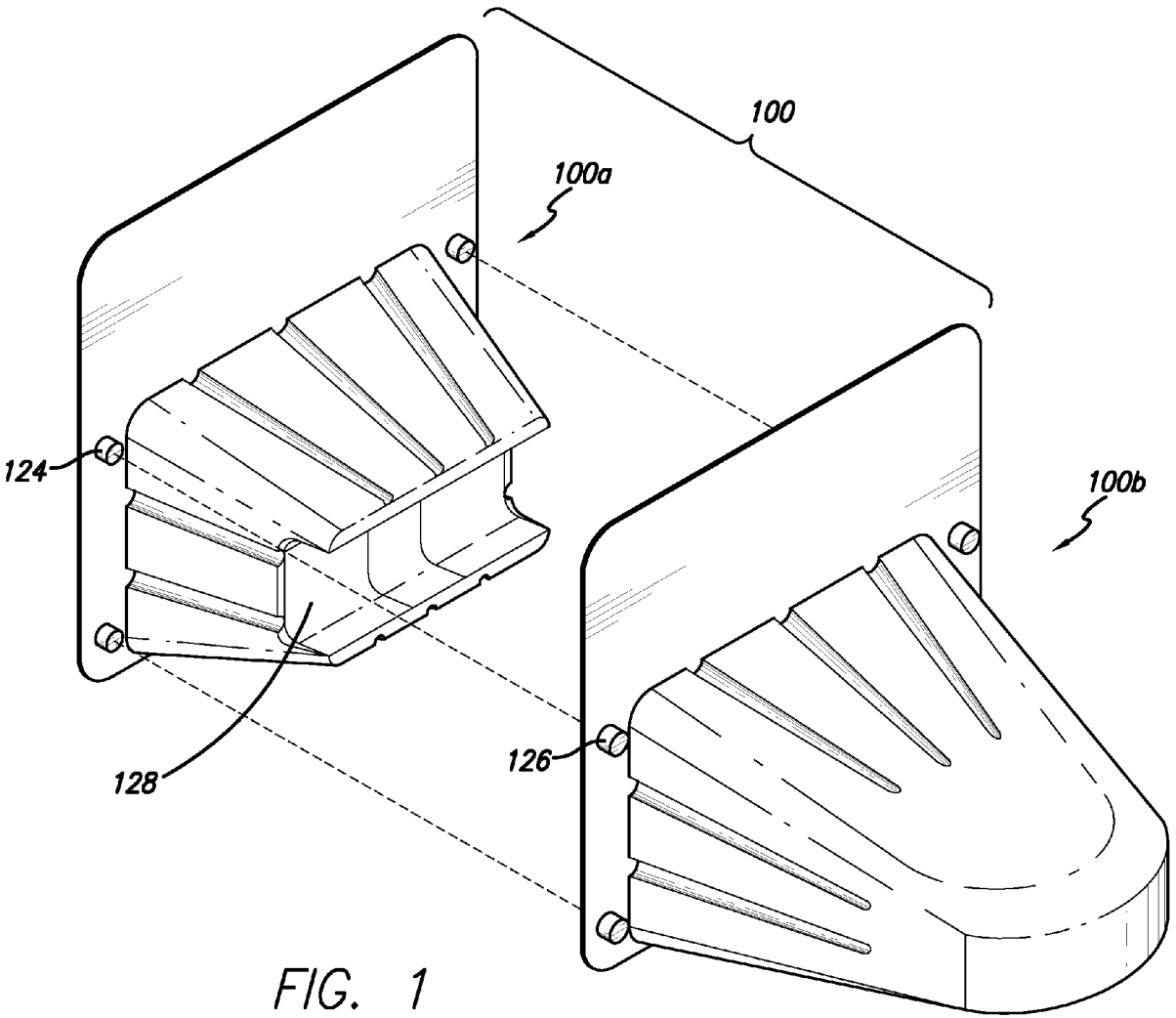
FIG. 1 is an exploded view of a clam shell packaging device having first and second pieces in accordance with a preferred embodiment of the present invention.
Figure 2:
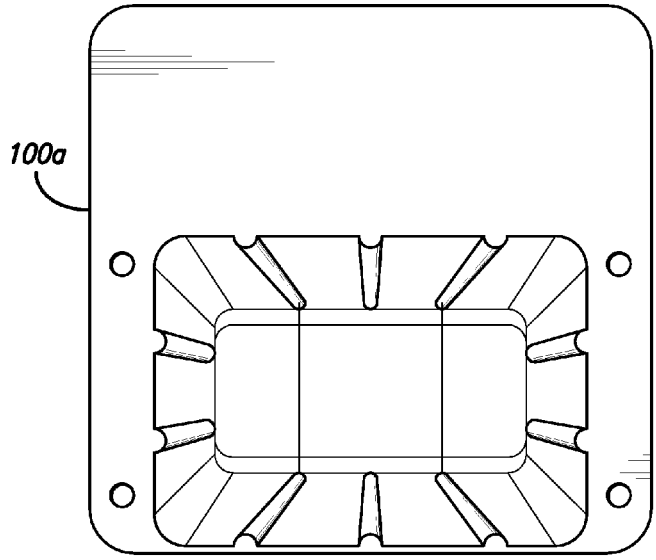
FIG. 2 is a back elevational view of the first piece of the clam shell packaging device of FIG. 1.
Figure 3:
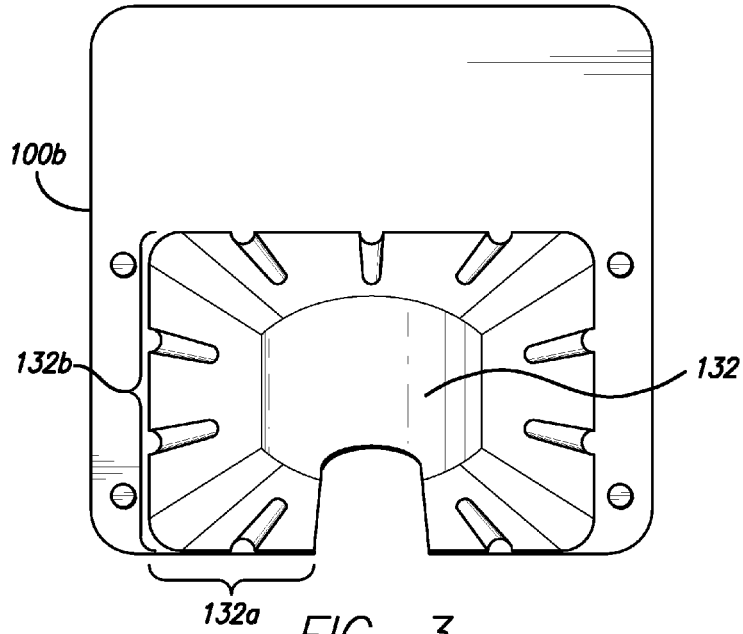
FIG. 3 is a back elevational view of the second piece of the clam shell packaging device of FIG. 1.

In accordance with one aspect of the present invention, there is provided a clam shell packaging device. The clam shell packaging device comprises a clam shell, wherein the clam shell is adapted to at least partially enclose a single wheel of a device with wheels. The clam shell further comprises a first portion and a second portion, wherein the first portion is adapted to at least partially enclose the second portion when the clam shell is in the closed or locked position. Preferably, the first portion and the second portion are separable. Preferably, the first piece substantially and securely or tightly encloses the second piece when the clam shell is in a closed or locked position.

In accordance with another aspect of the invention, a point sale display is provided. The point of sale display includes a pegboard, at least one peg extending from the pegboard, and a device having at least one wheel, wherein the wheel is at least partially enclosed by a clam shell. Preferably, the clam shell is adapted to at least partially enclose a single wheel of a device with wheels. Preferably, the clam shell includes a first portion and a second portion, wherein the first portion is adapted to at least partially enclose the second portion when the clam shell is in a closed or locked position.

In accordance with another aspect of the invention, a method of displaying devices with wheels at a point of sale is provided. The method includes the steps of providing a traditional pegboard point of sale display; providing a clam shell packaging device comprising a clam shell having a tab with an opening therein. Preferably, the clam shell includes a first portion and a second portion, wherein the first portion is adapted to at least partially enclose the second portion. The method further includes the steps of at least partially enclosing at least one wheel of the device with the clam shell packaging device and hanging at least two devices on the point of sale display.

In accordance with another aspect of the present invention, a method of reducing space by taking up inventory is provided. The method includes the step of providing a clam shell packaging device including a clam shell, wherein the clam shell is adapted to at least partially enclose a single wheel of a device with wheels. Preferably, the clam shell includes a first portion and a second portion, wherein the first portion is adapted to at least partially enclose the second portion when the clam shell is in a closed or locked position.

In accordance with another preferred embodiment of the present invention, there is provided a clam shell packaging device. The clam shell packaging device comprises a clam shell, wherein the clam shell is adapted to at least partially encase a single wheel of a device with wheels. The device with wheels may be a skateboard. The clam shell packaging device may include a toy having wheels wherein the wheels of the toy are encased by the clam shell.

In accordance with another aspect of the present invention, there is provided a point of sale display. The point of sale display includes a pegboard; at least one peg extending from the pegboard; and a device having at least one wheel, wherein the wheel is at least partially encased by a clam shell having a tab extending therefrom. Preferably, the tab has an opening the peg passes through the opening. The device may have two wheels, wherein each of the wheels is encased with a clam shell. The device may be a skateboard, wherein the skateboard is hung on the point of sale display, and the skateboard is positioned generally horizontally.

In accordance with another aspect of the present invention, there is provided a method for displaying devices with wheels at a point of sale. The method includes providing a traditional pegboard point of sale display; providing a clam shell packaging device having a tab with an opening therein; at least partially encasing at least one wheel of the device with the clam shell packaging device; and hanging at least two of the devices on the point of sale display.

In accordance with another aspect of the present invention, there is provided a method of reducing space taken up by inventory. The method includes providing a clam shell packaging device comprising a clam shell. The clam shell is adapted to at least partially encase a single wheel of a device with wheels.

In accordance with another aspect of the present invention, there is provided a device with wheels and a wheel holding device combination. The combination includes a device having at least two wheels and means for supporting each of the at least two wheels such that the device with wheels can hang stably from a pegboard. The means for supporting includes an opening through which a peg on the pegboard may pass.

DETAILED DESCRIPTION OF THE PREFERRED EMBODIMENTS

As shown in FIGS. 1-12, the present invention is directed to a clam shell type packing device that encloses at least a portion of at least one of the wheels of a wheeled device, such as a skateboard, and methods of using the same.

It will be appreciated that terms such as "front," "back," "top," "bottom," "left," "right," "above," and "side" used herein are merely for ease of description and refer to the orientation of the components as shown in the figures. It should be understood that any orientation of the components described herein is within the scope of the present invention.

Referring to FIGS. 1-8, the present invention is generally directed to a clam shell structure 100. As used herein, "clam shell structure" may be referred to as "clam shell packaging device" and/or "packaging device" and/or "clam shell." Preferably, the clam shell packaging device 100 encases wheel 18 of the wheeled toy 20 snugly, such that when the clam shell packaging device 100 is hanging the wheeled toy 20 on a pegboard 22, the pegboard 22 is able to support the weight of the wheeled toy 20. As used herein, "wheeled toy" may refer to "a device with wheels," "device" and/or any wheeled device with at least one wheel and is not limited to a "toy."

Figure 5A:
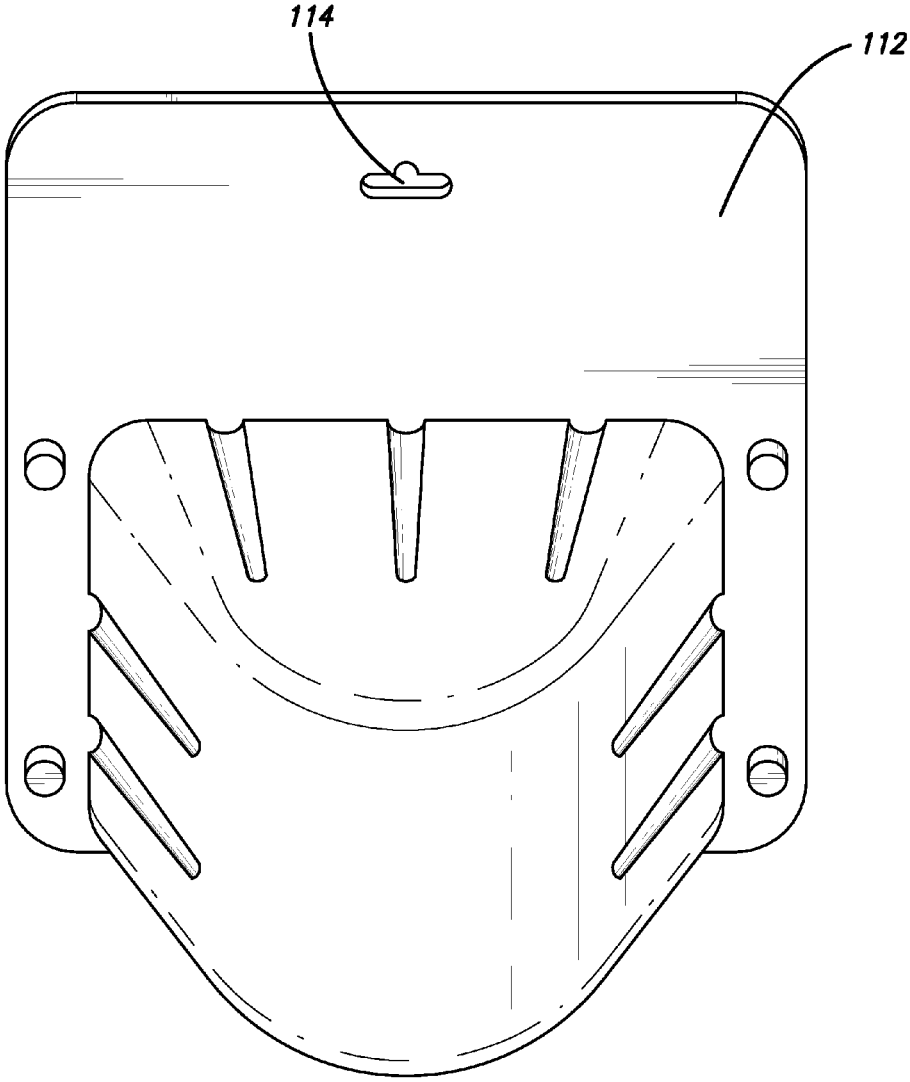
FIG. 5*a* is a back elevational view of the clam shell packaging device of FIG. 1 showing the second piece with a tab.
Figure 5B:
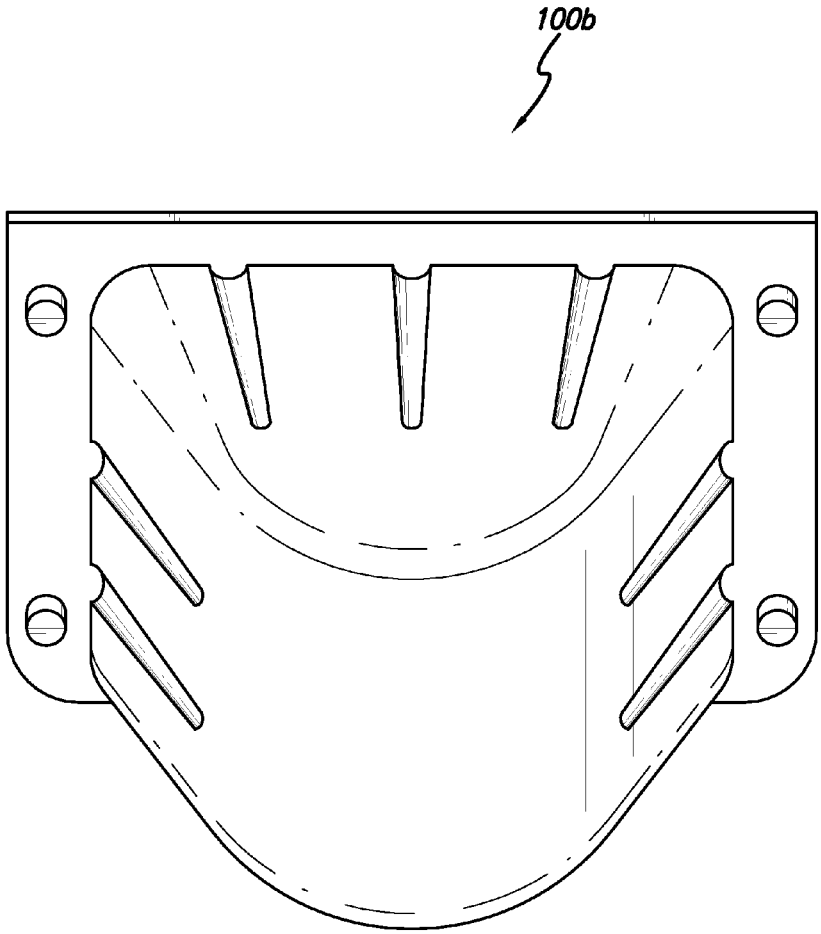
FIG. 5*b* is a back elevational view of the second piece of the clam shell packaging device of FIG. 1 showing the second piece without a tab.

In a preferred embodiment, and as best seen in FIG. 5*a*, the clam shell packaging device 100 preferably includes tab 112 having opening 114 allowing it to hang via a nail or pegboard peg. In other embodiments, the clam shell packaging device 100 may include more than one tab and/or more than one opening, as long as the wheeled device is stably supported by the pegboard when hung on display. In yet other embodiments, and as best seen in FIG. 5*b*, the clam shell packaging device may not include tab and/or opening and/or may include other means for attaching to pegboard, wall, shelf, and/or other similar structure.

Figure 6:
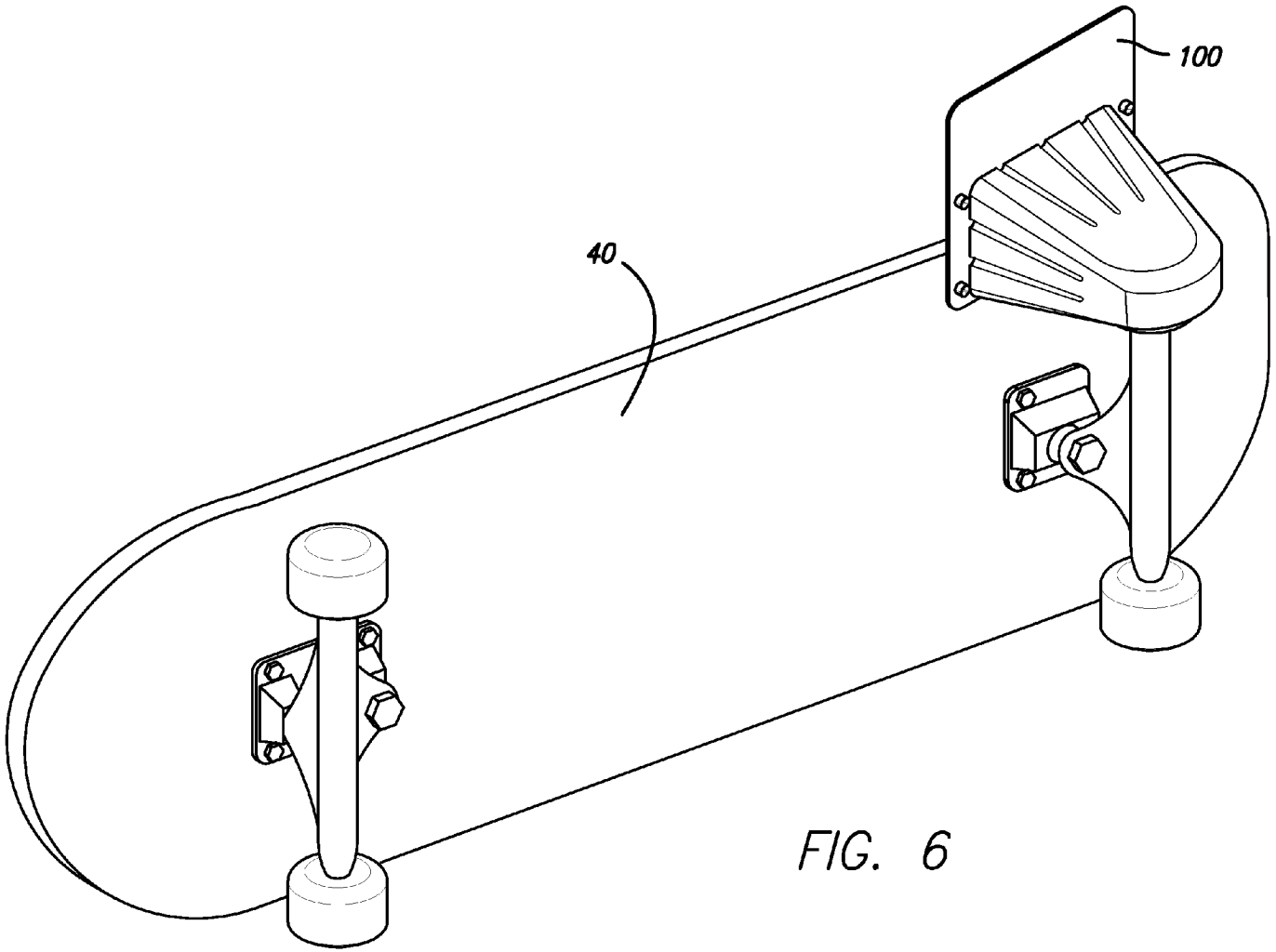
FIG. 6 is a perspective view of a skateboard having the clam shell packaging device of FIG. 1.
Figure 10:
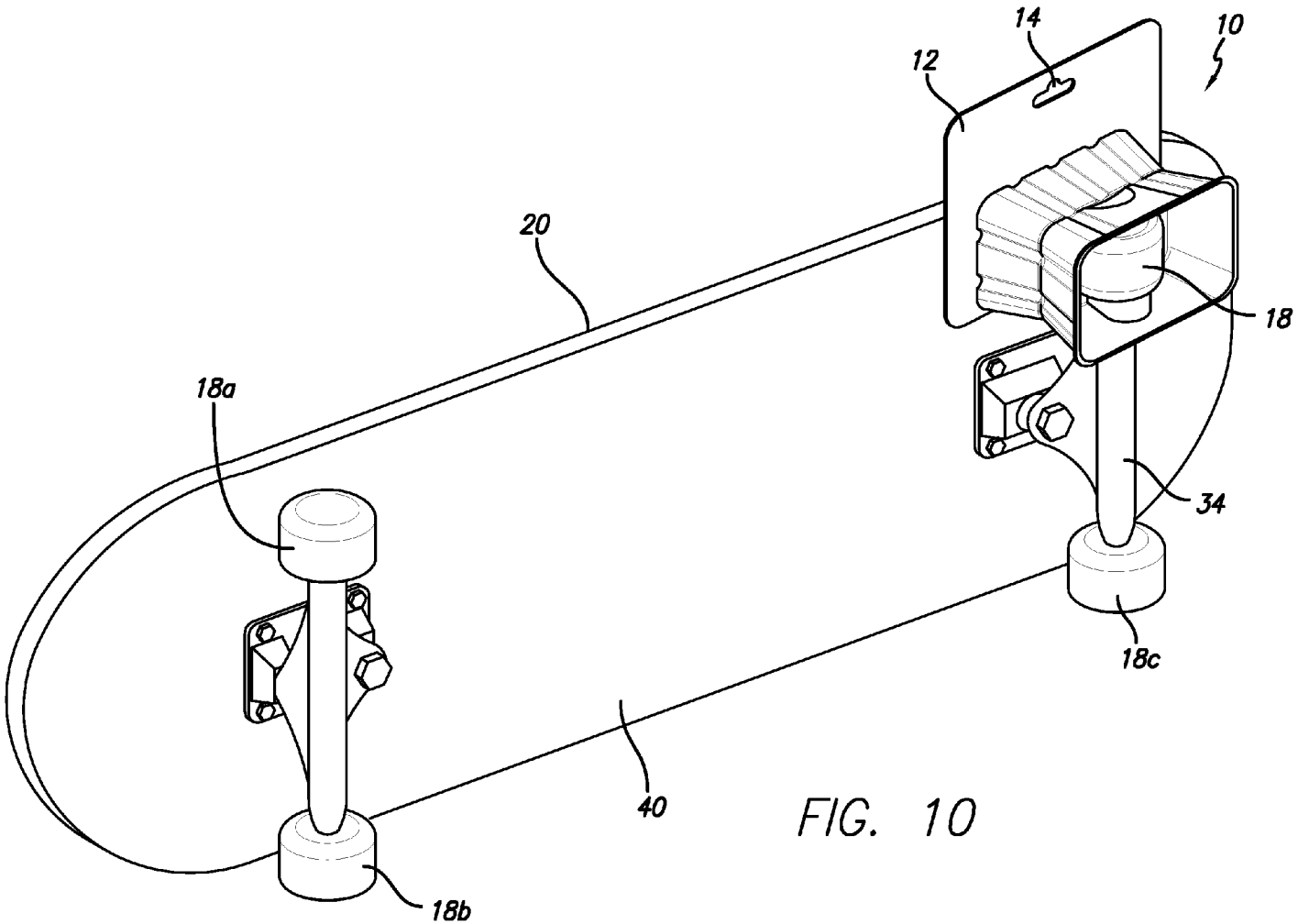
FIG. 10 is a perspective view of a skateboard having the clam shell packaging device of FIG. 9.
Figure 11:
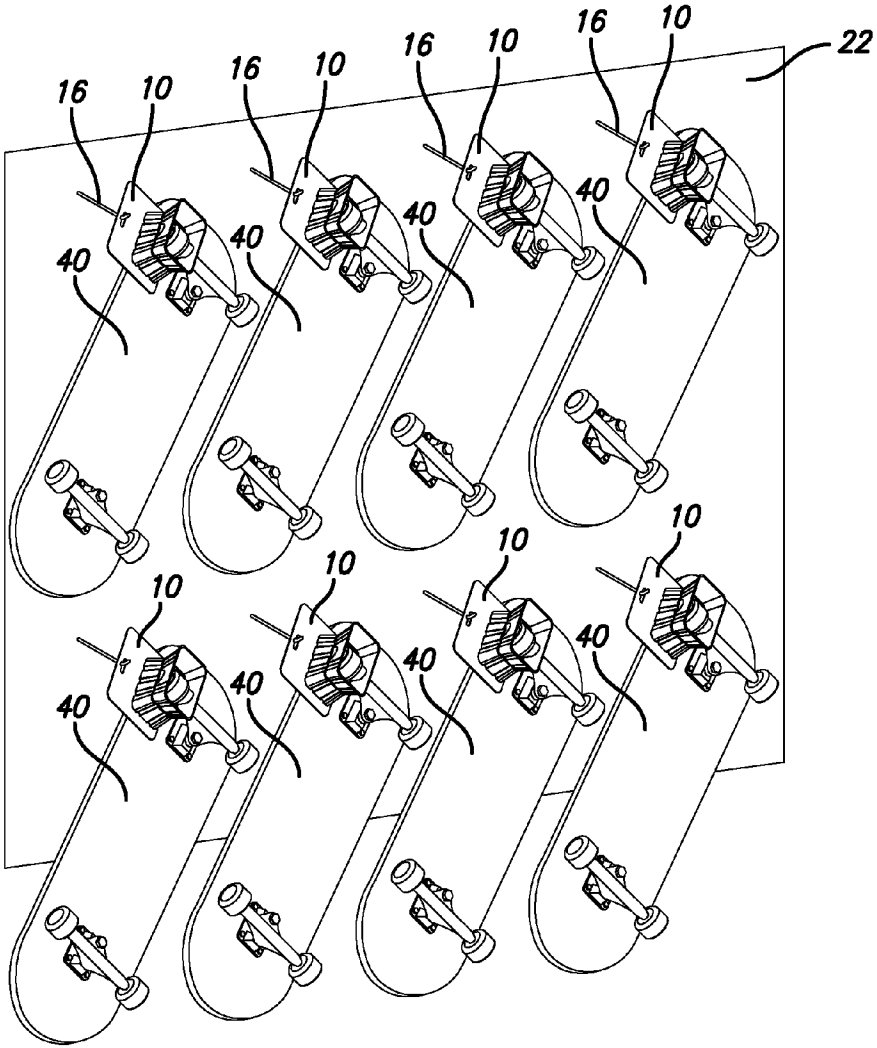
FIG. 11 is a perspective view of a traditional pegboard point of sale display with a number of skateboards each hanging from it via the clam shell packaging device of FIG. 9.

In a preferred embodiment, and referring to FIGS. 6 and 10, the wheeled toy 20 is a skateboard 40. In other embodiments, the wheeled toy 20 may be any other wheeled device as long as it has at least one wheel.

In a preferred embodiment, and as best seen in FIG. 1, the clam shell packaging device 100 includes a first portion 100*a* and a second portion 100*b*. Preferably, these portions are separable and may also be referred to herein as first piece 100*a* and second piece 100*b*. As such, as used herein, "first piece" may refer to "first portion," "first part," and/or "male part" and "second piece" may refer to "second portion," "second part," or female part. In other embodiments, the clam shell packaging device 100 may be one piece, such as a bi-fold clam shell, or may be three pieces, such as a tri-fold clam shell. In other embodiments, the first portion and the second portion are not separable, i.e., are attached together in some fashion in a bi-fold clam shell configuration, or the like.

In a preferred embodiment, and as best seen in FIG. 1, the first piece 100*a* and the second piece 100*b* may be connected together in a snap lock fashion. As such, the first piece 100*a* preferably includes four projections (referred to herein singly and collectively as "124") for connecting with second piece 100*b*. The second piece 100*b* preferably includes four depressions (referred to herein singly and collectively as "126") for receiving the projections 124. Preferably, the first piece 100*a* is connected with the second piece 100*b* when the projections 124 are inserted into the depressions 126 in a snap lock fashion. This may be referred to herein as the "closed position" and/or "locked/snap-locked position." In other embodiments, the first piece 100*a* and the second piece 100*b* may be connected/attached in any other manner such as fasteners, stapling, sealing, glue, Velcro, or the like.

In a preferred embodiment, when the first piece 100*a* is attached to the second piece 100*b*, the clam shell packaging device 100 completely or nearly completely and snugly encases wheel 18, and opening 134 at least partially and snugly encases truck 34 of skateboard 40. In other embodiments, the clam shell packaging device may not completely or nearly completely encase wheel. For example, the clam shell packaging device 100 may at least partially encase wheel 18.

In a preferred embodiment, and referring to FIG. 1, the second piece 100*b* substantially or fully encloses and/or encases the first piece 100*a* when the clam shell packaging device 100 is in a closed and/or locked position. As used herein, "closed" refers to the position wherein the first piece and the second piece are engaged together, with or without a wheel at least partially enclosed/encased therein. Preferably, first piece substantially or fully encloses the second piece in a tight and/or secure manner. In this regard, and referring to FIGS. 1 and 3, the second piece 100*b* preferably includes an opening 132 for receiving a protruded portion 130 on the first piece 100*a*. Preferably, and referring to FIGS. 3 and 7, the opening 132 is of a sufficient width 132*a* and height 132*b*, at any given depth of the opening 132, and the protruded portion 130 is of a sufficient width 130*a* and height 130*b* at any depth of the protruded portion 130, such that the protruded portion 130 is substantially or fully snugly received in the opening 132 of the second portion 100*b* in the closed and/or locked position. Preferably, the protruded portion 130 is substantially of fully snugly received in the opening when the first piece 100*a* at least partially encloses the wheel 18. In this manner, the strength of the clam shell packaging device and its ability to stably support the weight of the wheeled toy is increased. In other embodiments, the second piece 100*b* may not substantially or fully snugly enclose and/or encase the protruded portion 130 of the first piece 100*a*. In yet other embodiments, the second piece 100*b* may at least partially snugly enclose and/or encase the protruded portion and/or the first piece when the clam shell packaging device is in the closed and/or locked position. In other embodiments, first piece may not include protruded portion.

Figure 4:
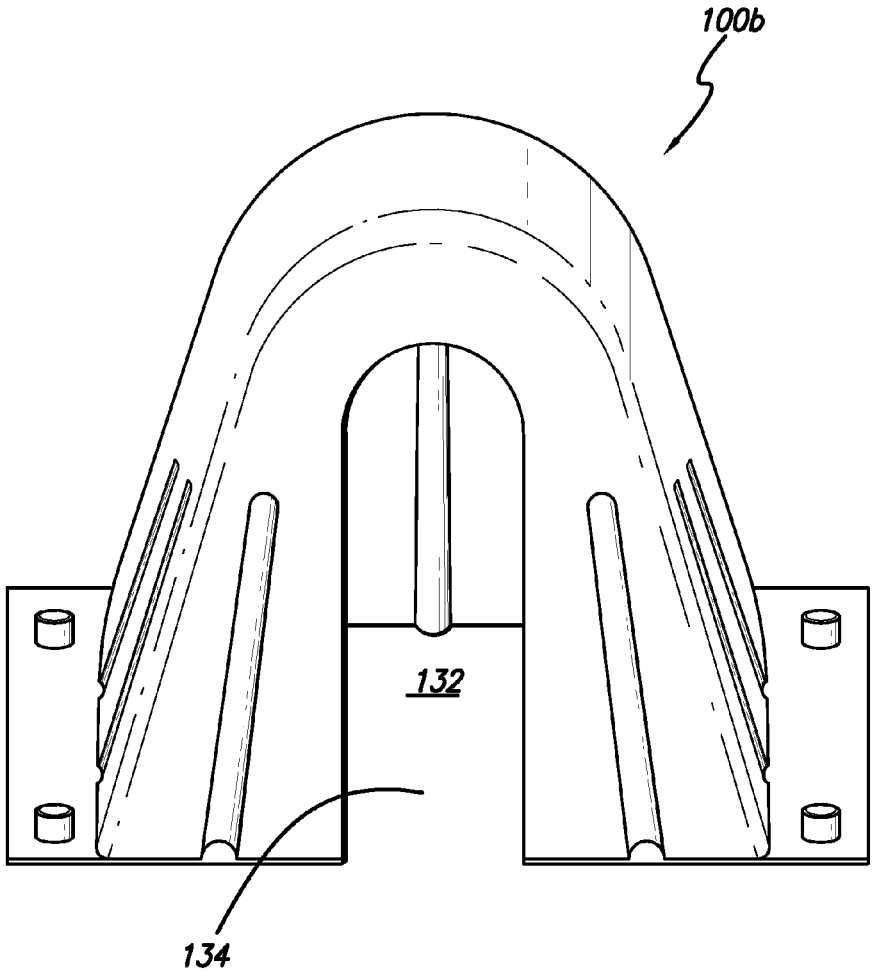
FIG. 4 is a bottom view of the second piece of the clam shell packaging device of FIG. 1.
Figure 7:
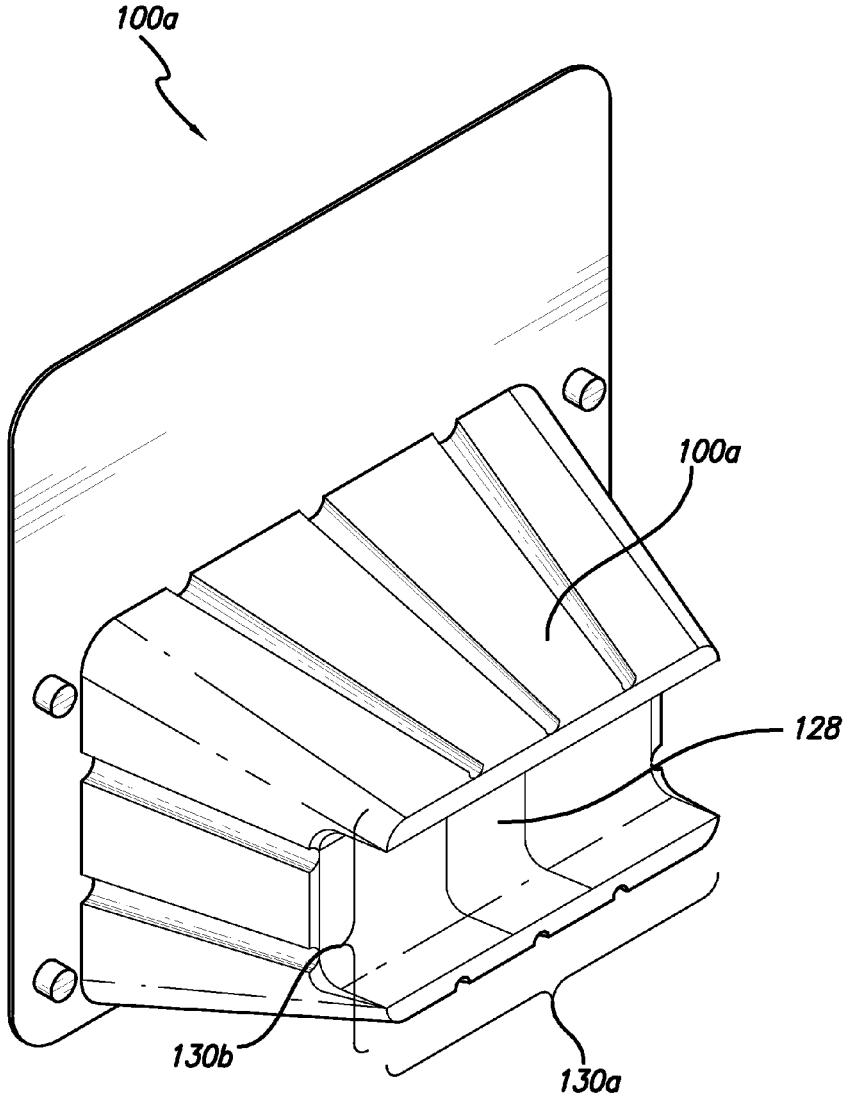
FIG. 7 is a perspective view of the first piece of the clam shell packaging device of FIG. 1.

In a preferred embodiment, and referring to FIG. 7, the first piece 100*a* includes pocket 128 for at least partially encasing wheel 18. Preferably, and referring to FIG. 3, the second piece 100*b* includes a pocket 132 on its backside for at least partially encasing wheel 18. In addition, and as best seen in FIG. 4, the second piece 100*b* preferably includes an opening 134 on its bottom side for receiving truck 34 of skateboard 40. Preferably, the opening 134 is from about 1 to about 10 cm long and from about 0.5 to about 3 cm wide. In a more preferred embodiment, the opening 134 is from about 2 to about 8 cm long and from about 1 to about 2.5 cm wide. In a highly preferred embodiment, the opening 134 is from about 3 to about 6 cm long and from about 1.5 to about 2 cm wide. In other embodiments, the first piece 100*a* may not include pocket 128 or the second piece 100*b* may not include pocket 132 and/or opening 134. For example, the wheel 18 could be nearly or completely encased by pocket 132 without need for pocket 128. In addition, opening 132 and/or opening 134 may receive any other structure (other than the truck of a skateboard) that supports one or more wheels of the wheeled toy. In yet other embodiments, the opening 132 and/or opening 134 may be any size (i.e., any length or width) and may vary with the size of the wheel and/or truck inserted therein.

In accordance with another preferred embodiment of the present invention, and referring to FIGS. 9-12, a clam shell structure 10 is provided.

Figure 9:
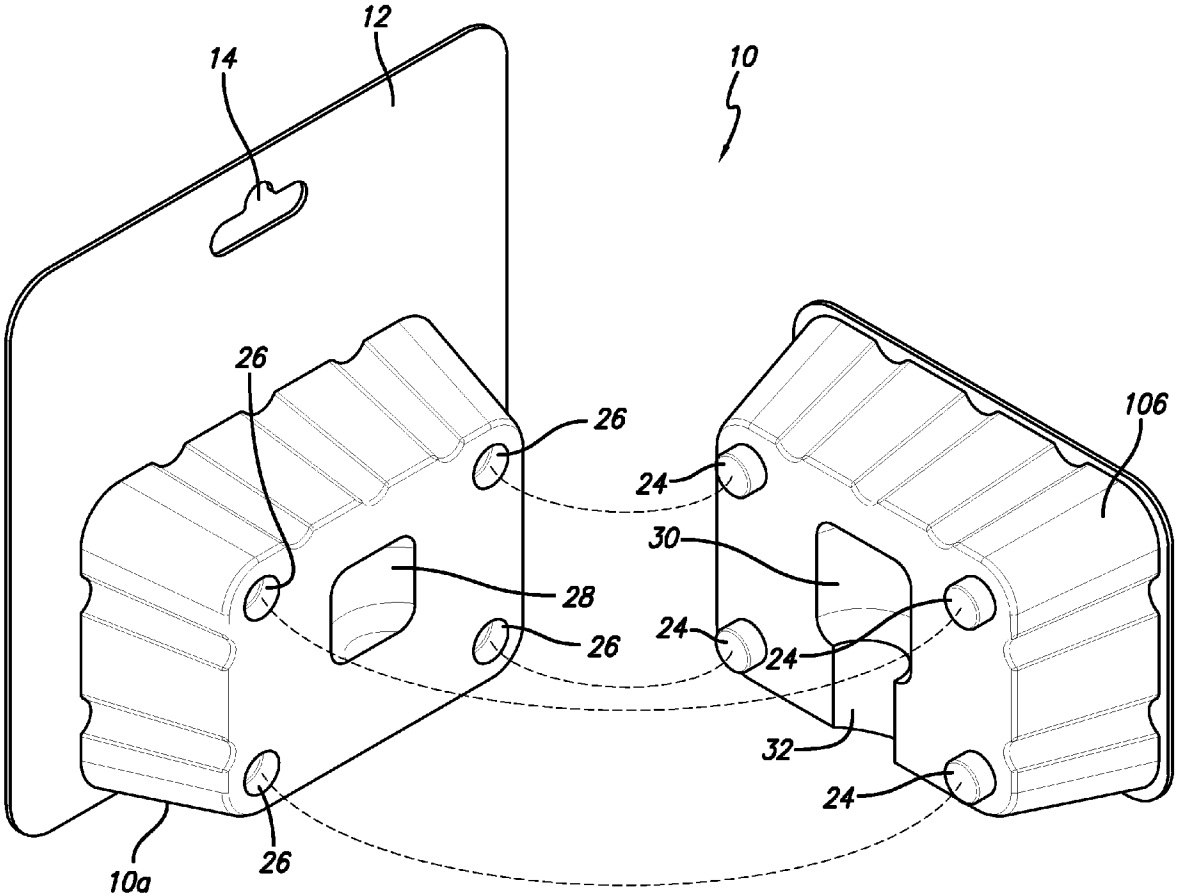
FIG. 9 is an exploded view of a clam shell packaging device in accordance with another preferred embodiment of the present invention.

In a preferred embodiment, and as best seen in FIG. 9, the clam shell packaging includes two pieces, referred to herein as first piece 10*a* and second piece 10*b*. In other embodiments, the clam shell packaging device may be one piece, such as a bi-fold clam shell, or may be three pieces, such as a tri-fold clam shell.

Figure 8:
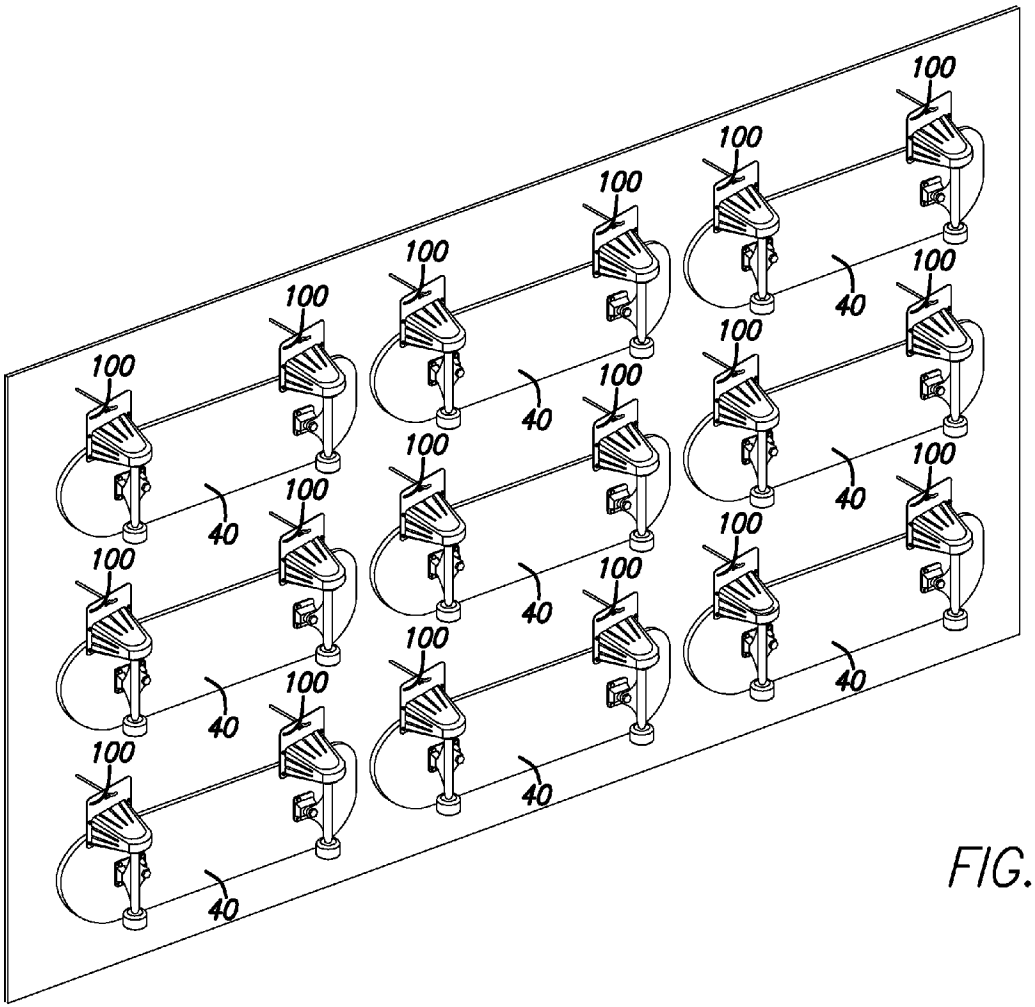
FIG. 8 is a perspective view of a traditional point of sale display with a number of skateboards each hanging from it via the two clam shell packaging devices of FIG. 1.

In a preferred embodiment, and referring to FIG. 8, the first piece 10*a* and the second piece 10*b* may be connected together in a snap lock fashion. As such, the second piece 10*b* preferably includes four projections (referred to herein singly and collectively as "24") for connecting with the first piece 10*a*. The first piece 10*a* preferably includes four depressions (referred to herein singly and collectively as "26") for receiving the projections 24. Preferably, the first piece 10*a* is connected with the second piece 10*b* when the projections 24 are inserted into the depressions 26 in a snap lock fashion. In other embodiments, the first piece 10*a* and the second piece 10*b* may be connected/attached in any other manner such as fasteners, stapling, sealing, glue, Velcro, or the like.

In a preferred embodiment, and referring to FIG. 9, the first piece 10*a* includes tab 12, and pocket 28 for at least partially encasing wheel 18. In a preferred embodiment, the second piece 10*b* includes a pocket 30 for at least partially encasing wheel 18. In addition, the second piece 10*b* preferably includes opening 32 for receiving truck 34 of a skateboard 40. In other embodiments, the first piece 10*a* may not include pocket 28 or the second piece 10*b* may not include pocket 30. For example, the wheel 28 could be nearly or completely encased by pocket 30 without need for pocket 28. In addition, opening 32 may receive any other device (other than truck of skateboard) that supports one or more wheels of wheeled toy.

In a preferred embodiment, when the first piece 10*a* is attached to the second piece 10*b*, the clam shell packaging device 10 completely or nearly completely and snugly encases wheel 18, and the opening 32 at least partially and snugly encases truck 34 of skateboard 40. In other embodiments, the clam shell packaging device may not completely or nearly completely encase wheel. For example, the clam shell packaging device 10 may at least partially encase wheel 18.

In a preferred embodiment, and as seen in FIGS. 5*a*, 9 and 10, the opening 14 or opening 140 is designed for a pegboard peg 16 or other similar device such as a nail to pass through the opening 14 or opening 140 such that the wheeled toy 20 may be hung on a traditional pegboard point of display 22. When hung, the weight of the wheeled toy is preferably supported by the pegboard.

In a preferred embodiment, the clam shell packaging device 10 or 100 is comprised of polypropylene, polyvinyl chloride ("PVC") and/or polyethylene terephthalate ("PET"). Preferably, the clam shell packaging device 10 or 100 is clear. In other embodiments, the clam shell packaging device may be made of any other material or combinations thereof, and/or may not be clear. Preferably, the clam shell packaging device 10 or 100 is comprised of a material that allows it to support the wheeled device is hung on display.

In a preferred embodiment, use of the clam shell packaging device of the present invention reduces the amount of space needed for storing/displaying the wheeled toys. Preferably, use of the clam shell packaging as opposed to traditional cardboard packaging reduces the storage/display space needed by at least about 25%, more preferably by at least about 30%, and most preferably by at least about 50%. In a highly preferred embodiment, the storage/display space needed is reduced by at least 56%. Accordingly, the distributor/retailer, for example, has more space available to sell other products and thereby potentially make more profits.

Figure 12:
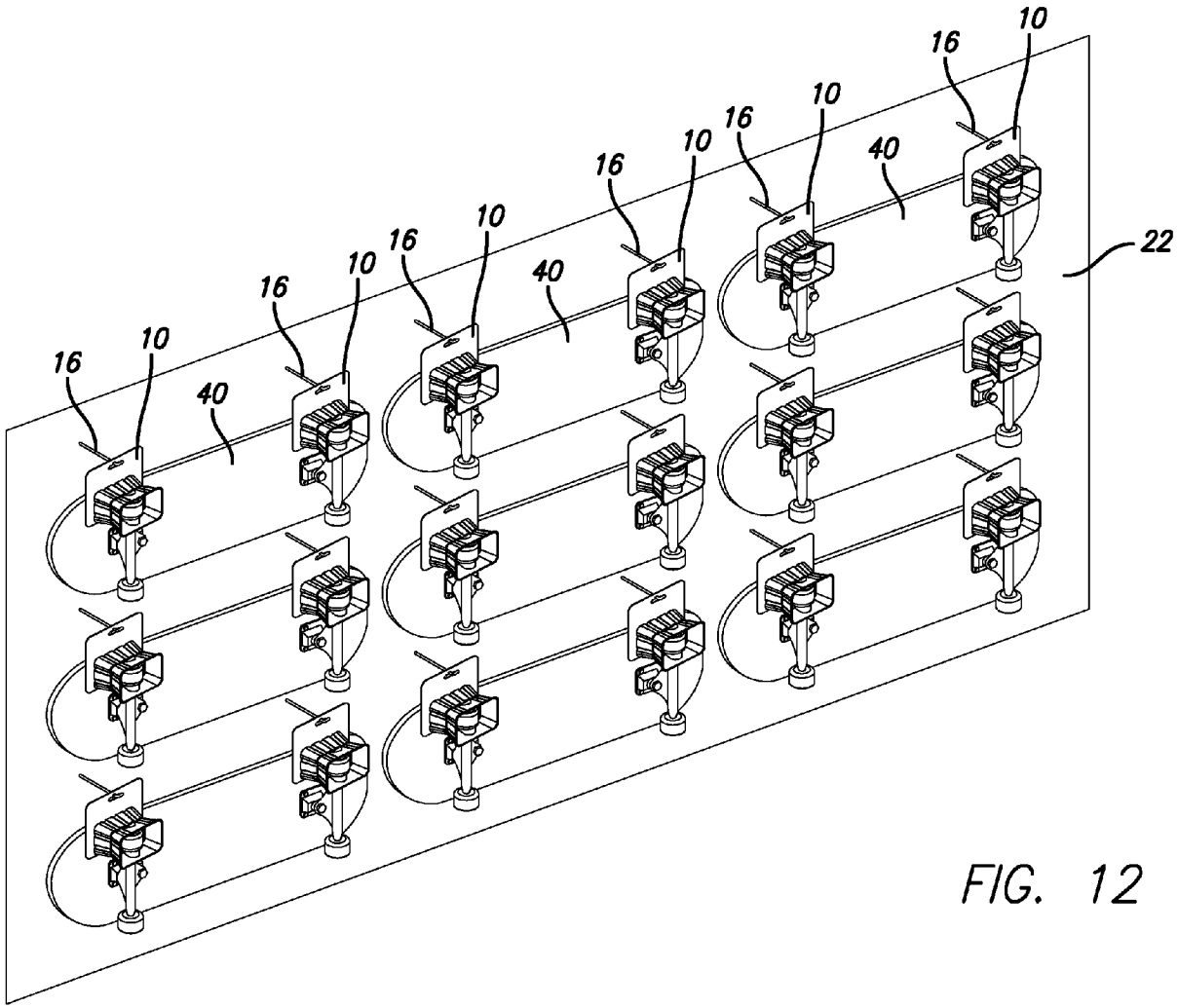
FIG. 12 is a perspective view of a traditional pegboard point of sale display with a number of skateboards each hanging from it via the two clam shell packaging devices of FIG. 9.

In a preferred embodiment, and referring to FIGS. 8 and 12, two clam shell packaging devices 10 or two clam shell packaging devices 100 encase two wheels 18 and 18*a* (or, alternatively, encase wheels 18*c* and 18*b*) of the wheeled toy 20. Alternatively, a single clam shell packaging device 10 or 100 may encase two wheels. In other embodiments, two side wheels 18 and 18*c* (or, alternatively, wheels 18*a* and 18*b*), may be encased by a single clam shell packaging device, or by two clam shell packaging devices. In yet other embodiments, only a single clam shell device encases a single wheel on the wheeled toy. In yet other embodiments, clam shell packaging device 10 may encase one wheel, and clam shell packaging device 100 may encase another wheel, of wheeled toy.

Alternatives to the clam shell structure include other structures or devices which are able to support a skateboard by at least one wheel while the skateboard is hanging from a pegboard. Thus any means for supporting a skateboard by at least one wheel and preferably two wheels such that the skateboard can be stably hung from a pegboard and such that the means for supporting includes an opening through which a peg on a pegboard may pass, are within the scope of the present invention. Such structures include in addition to the clam shell structures, hooks which have two ends, one of which supports a wheel and the other of which has an opening through which the peg can extend; and a hanger or other clip-like structure that can clip onto a wheel and which includes a tab or other such structure with an opening through which a peg can extend.

While certain embodiments of the invention have been described, these embodiments have been presented by way of example only, and are not intended to limit the scope of the inventions. Indeed, the novel methods and elements described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A clam shell packaging device comprising a clam shell in combination with a toy having at least a first and second wheel mounted on an axle, wherein the clam shell comprises a first portion and a second portion that cooperate to define a pocket, wherein the first portion at least partially encloses the second portion, wherein the first wheel is received in the pocket, and wherein the axle extends through an opening in one of the first and second portions to the exterior of the clam shell.

2. The clam shell packaging device of claim 1, wherein the first portion and the second portion are separable.

3. The clam shell packaging device of claim 2, wherein the first portion substantially and securely encloses the second portion.

4. The clam shell packaging device of claim 1, wherein the toy is a skateboard.

5. The clam shell packaging device of claim 1, wherein a tab is attached to the clam shell.

6. The clam shell packaging device of claim 5, wherein the tab comprises an opening.

7. The claim shell packaging device of claim 1, wherein the clam shell is adapted to stably support the toy when the toy is hung from a nail or pegboard peg.

8. The clam shell packaging device of claim 1, further comprising a second clam shell, wherein the second wheel is received in the second clam shell.

9. A point of sale display comprising:

(a) pegboard;

(b) at least one peg extending from the pegboard;

(c) the clam shell packaging device of claim 1 having a tab extending therefrom, the tab having an opening; and wherein said at least one peg passes through the opening.

10. The point of sale display of claim 9, wherein each of the first and second wheels is encased with a clam shell.

11. The point of sale display of claim 10, where the device is a skateboard, and wherein the skateboard is hung on the point of sale display, and the skateboard is positioned generally horizontally.

12. A method for displaying devices with wheels at a point of sale, the method comprising:

(a) providing a traditional pegboard point of sale display;

(b) providing a clam shell packaging device comprising a clam shell having a tab with an opening therein; wherein the clam shell comprises a first portion and a second portion, wherein the first portion is adapted to at least partially enclose the second portion;

(c) at least partially enclosing at least one wheel of said devices, and wherein an axle extends through an opening in one of the first and second portions to the exterior of the clam shell to connect said at least one wheel with another wheel outside the clam shell; and (d) hanging at least two of the devices on the point of sale display.

13. The method of claim 12, wherein the devices are skateboards.

14. A method of reducing space taken up by inventory, the method comprising providing the claim shell packaging device of claim 1.

15. A device comprising:

a deck, first and second trucks attached to the bottom of the deck, first and second wheels rotatably secured to the first truck and third and fourth wheels rotatably secured to the second truck, and a first clam shell device that includes first and second pieces that cooperate to define a wheel receiving pocket and a truck opening, wherein the first wheel is received in the wheel receiving pocket and the first truck extends through the truck opening to the outside of the first clam shell device, wherein the deck and the second, third and fourth wheels are all located outside of the first clam shell device.

16. The device of claim 15 further comprising a second clam shell device that includes first and second pieces that cooperate to define a wheel receiving pocket and a truck opening, wherein the third wheel is received in the wheel receiving pocket and the second truck extends through the truck opening to the outside of the second clam shell device, wherein the deck and the second and fourth wheels are all located outside of the first and second clam shell devices, and wherein the first truck extends downwardly through the truck opening in the first clam shell device and the second truck extends downwardly through the truck opening in the second clam shell device.

* * * * *